US005325637A

United States Patent [19]

Yasuda et al.

[11] Patent Number: 5,325,637

[45] Date of Patent: Jul. 5, 1994

[54] DEVELOPING APPARATUS WITH AN IMPROVED SLEEVE

[75] Inventors: Kazuo Yasuda; Hiroyuki Tokimatsu; Masakazu Fukuchi; Meizo Shirose; Yoshiaki Kobayahi, all of Hachioji, Japan

[73] Assignee: Konica Corporation, Tokyo, Japan

[21] Appl. No.: 965,205

[22] Filed: Oct. 23, 1992

[30] Foreign Application Priority Data

Oct. 31, 1991 [JP] Japan ..... 3-286616
Dec. 19, 1991 [JP] Japan ..... 3-336655

[51] Int. Cl.[5] ..... B24C 1/06

[52] U.S. Cl. ..... 51/319; 51/289 R; 51/326

[58] Field of Search ..... 51/319, 320, 321, 326, 51/289 R, 419

[56] References Cited

U.S. PATENT DOCUMENTS

| | | | |
|---|---|---|---|
| 3,691,030 | 9/1972 | Strosynski | 51/319 |
| 4,714,528 | 12/1987 | Takeuchi et al. | 51/321 |
| 4,739,591 | 4/1988 | Everhardus et al. | 51/319 |
| 4,851,091 | 7/1989 | Uesugi et al. | 51/319 |
| 4,909,894 | 3/1990 | Uesugi et al. | 51/321 |

FOREIGN PATENT DOCUMENTS

| | | |
|---|---|---|
| 54-43038 | 4/1979 | Japan . |
| 54-51848 | 4/1979 | Japan . |
| 59-126567 | 7/1984 | Japan . |
| 59-129879 | 7/1984 | Japan . |
| 60-12627 | 1/1985 | Japan . |
| 61-189582(A) | 8/1986 | Japan . |
| 62-75563(A) | 4/1987 | Japan . |
| 62-191868(A) | 8/1987 | Japan . |
| 62-191869(A) | 8/1987 | Japan . |
| 2-50184(A) | 2/1990 | Japan . |

*Primary Examiner*—Robert A. Rose
*Attorney, Agent, or Firm*—Frishauf, Holtz, Goodman & Woodward

[57] ABSTRACT

An developer for developing a latent image with a developing agent such as toner. The developer includes a developing sleeve for holding the developing agent on its surface, in which magnetic poles are provided in the developing sleeve; a equalizer bar for equalizing the amount of the developing agent on the surface of the developing sleeve; a pressing member to press the equalizer bar onto the developing sleeve. In the developer, a radius of curvature of the equalizer bar is between 0.5 mm and 15 mm, and the developing sleeve is processed to have a jagged surface which is defined by a glossiness between 2% Gs and 1400% Gs (20°).

5 Claims, 20 Drawing Sheets

FIG. 8 ( a )
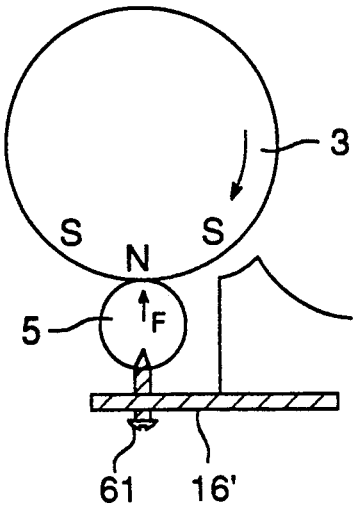
FIG. 8 ( b )
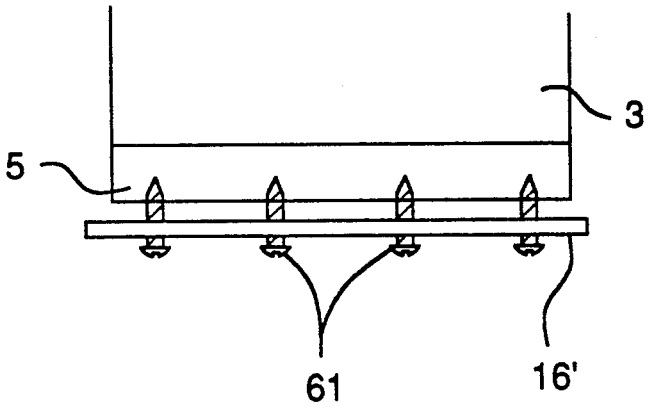
FIG. 9
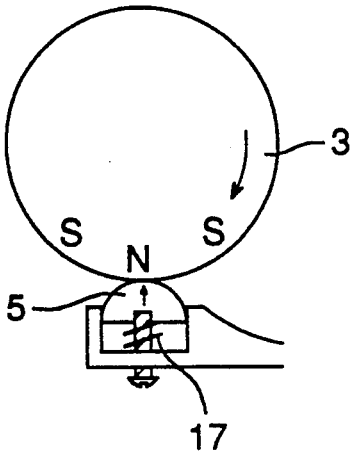

DEVELOPING APPARATUS WITH AN IMPROVED SLEEVE

BACKGROUND OF THE INVENTION

The present invention relates to a developing apparatus for development of a latent image on an image forming retainer for use in an image forming machine, particularly in an electrophotographic image forming machine.

In order to obtain a quality image in the electrophotographic image forming machine using a one-component or two-component developer, it is necessary to form a thin and uniform developer layer on a developer retainer (hereinafter also referred to as the developing sleeve 3, or the sleeve, as shown in FIG. 1, for example).

Conventionally, a developer amount limiting member (hereinafter also referred to as the developer layer limiting member or the developer layer thickness limiting member) has been used for many years constituted of a fixed limiting plate used to equalize the layer thickness. A lower limit of the layer thickness has been approximately 0.3 mm because fastening the developer retainer with the fixed limiting plate has a limited mechanical accuracy. With such a method using the fixed limiting plate it is difficult to obtain a uniform thin layer without unevenness. In addition to the fixed limiting plate, there have been proposed various developer layer limiting devices in order to obtain a uniform thin layer. For example, these include the following:

a. The developer layer forming device disclosed in Japanese Patent Application Laid-Open No. 54-43038/1979 includes a developer layer limiting member made of an elastic plate having a free end which is deflected to press the developer retainer for use with a one-component toner.

b. The developer layer forming device disclosed in Japanese Patent Application Laid-Open No. 54-51848/1979 uses an elastic plate having a metal spring and a soft elastic segment laminated together to make a plate-like surface of which a soft elastic segment presses against a developer retainer to limit the layer thickness of a one-component developer.

c. The developer layer forming device disclosed in Japanese Patent Application Laid-Open Nos. 59-126567/1984 and 59-129879/1984 is to presses an intermittently or continuously rotating elastic roller to a developer retainer to make a nip between the limit layer thickness of a developer in a developing apparatus using a one-component developer.

d. The developer layer forming plate disclosed in the Japanese Patent Publication No. 60-12627/1985 places a rotating roller in contact with a developer retainer of elastic material to limit the layer thickness of a one-component developer in a developing apparatus using a one-component developer.

e. The Japanese Patent Application Laid-Open Nos. 62-191868/1987 and 62-191869/1987 disclose technical means for forming thin developer layers on a developing sleeve 3 useful for non-contact development in order to make the prior devices mentioned above available for two-component developers.

In these disclosures, an end of an elastic plate held by a supporting member is directed toward an upstream portion of a developer on a developing sleeve 3 and is pressed to the developing sleeve 3. This limits the layer thickness of the developer by a magnetic carrier and a toner adhered to and conveyed by the developing sleeve 3. This makes a highly accurate thin developer layer which is easier to form as compared with the previous limiting means.

f. The developing apparatuses using the two-component developer disclosed in the Japanese Patent Application Laid-Open Nos. 61-189582/1986 and 62-75563/1987 have a solid plate-like layer thickness limiting member and a magnetic member on its rear side. The attraction force of a fixed magnet assembly provided in a developer retainer indirectly presses a surface or bent edge of the limiting plate to limit the layer thickness.

g. Japanese Patent Application Laid-Open No. 2-50184/1990 discloses a technique for limiting layer thickness with use of a pressure limiting magnetic bar.

The developer layer forming devices proposed previously involve the following defects. Since both the devices in the prior arts a and b mentioned above use pressure caused by deflection of the elastic layer thickness limiting member, the pressure is likely changed with variation of the rotational speed and pressing position of the developer retainer and the developer layer thickness. Also, since they do not only likely vibrate, but also have no means for suppressing the vibration, they resonate and vibrate with the vibration caused in the image forming apparatus. Thus, it is hard to obtain uniformly the developer layer having a equalized thickness. In particular, the device in the prior art b produces such an adverse effect due to a great extent to pressure applied by the soft elastic member. In addition, a geometrical shape of the pressing member (nip) is likely disturbed by variation of the rotational speed and pressing position of the developer retainer and the developer layer thickness, resulting in a change of the area of the nip. It is a problem that the developer layer thickness is liable to have irregularities. In addition to such difficulties, if one or both of the nips are made of soft elastic material, they become clogged with the developer, and the elastic material wears with time. These difficulties occur to the developer, particularly in the developer containing a magnetic material and fluidizing agent. The device in the prior art c mentioned above can obtain a more stable, uniform thin developer layer than the one in the prior art a, but is inferior in capabilities of demolishing or removing coagulated particles of the developer as its layer limiting means is made of a rotating matter. The coagulated particles are retained by the nip portion and made to pass through with rotation of the rotating matter. This means that the desired performance cannot always be obtained by the intermittent rotation, resulting in image contamination and black spots leading to deterioration of the image. The device is defective as its rotating and pressing arrangements are complicated to balance the pressure.

In any of the prior art devices a to d mentioned above, the layer thickness limiting member has a large pressing area. This adversely causes variation of the developer layer thickness with time corresponding to changes of in the amount of developer fed to the nip portion with time in the ordinary developing apparatus.

The devices in the prior arts c and d are useful for the non-magnetic, one-component developer. They form a thin developer layer in the way that the developer layer thickness limiting member is pressed to the elastic developer retainer. However, they cannot be stable in forming the developer layer as the developer retainer is likely to be permanently deformed, and the developer layer thickness limiting member is changed in elasticity in a long period of operation.

Also, the means in prior art e innovated for the two-component developer cannot be maintained in an operable condition in a long period of operation.

Further, the prior arts a, b, e, and f are to form the thin layer in the way that the elastic developer layer thickness limiting plate is pressed to the stiff developer retainer (metal sleeve). However, they have the disadvantage that the layer thickness limiting plate is short in durability as the elastic plate is likely to change in elasticity and be deformed permanently. Besides, if an installation position of the elastic plate is deviated a little, its end allowance and the pressure are changed. It is hard to stably limit the layer thickness. This is a critical disadvantage in that the installation accuracy is extremely severe in mass production.

The developing apparatus in the prior art f has a feature that the two magnets provided on the rear side of the developer layer thickness limiting member and inside the developer retainer function to demolish the coagulated toner to some degree. However, as this uses attraction through the fixed plate-like limiting member, the attractive force decreases promptly with the distance between both magnets. The pressure, therefore, is likely varied with a change of distance. The pressure effect to the developer layer cannot be stable nor uniform. These lead to the disadvantages that the coagulated toner or developer is made to pass through or conversely, irregular layer thickness causes clogging, resulting in white streaks in the image.

The technique disclosed in the prior art g overcomes most of the disadvantages of the preceding prior arts discussed above, but is not successful and leaves critically important problems unsolved. That is, recent toners are progressively made lower in the softening point in view of use of color toner, energy saving, and low power consumption. In connection to this, the developing sleeve 3 is rubbed with the developer amount limiting member. The toner itself is melted. The melted toner sometime sticks to the developing sleeve 3 and the developer amount limiting member of bar. A cause is that the developing sleeve 3 has irregular, sharp projections on its surface which is generally round. The projections allow conveyance of the developer, but are so sharp that friction heat would be likely generated. Sticking of the toner changes the developer conveyance amount. This causes severe defects, such as concentration unevenness and decrease.

Such drawbacks as described above will not frequently happen and are not normally problematic. But, if it occurs it is a serious difficulty. Such problems can not be allowed to occur often.

In view of the foregoing, it is an object of the present invention to provide a developing apparatus that can form a developer layer thickness on the developer retainer uniformly and stably and can prevent coagulated developer and toner from moving to a developing area, thereby being capable of stably reproducing quality images.

SUMMARY OF THE INVENTION

Briefly, the foregoing object is accomplished in accordance with aspects of the present invention by any of the following technical means a, b, c, d, and e.

a. A developing apparatus comprising a fixed magnet assembly, a stiff developer retainer having the magnet assembly provided therein and a developer retained on a surface thereof, and a developer amount limiting member like a bar which is faced with the magnet assembly and is pressed to the developer retainer to limit the developer amount retained on the developer retainer, characterized in that the developer amount limiting member is made of a stiff material on a pressing portion thereof to press the developer retainer, a radius of curvature of the pressing portion is 0.5 to 15 mm, the developer retainer has irregularities formed on the surface for retaining the developer, and a glossiness on the surface is 2 to 1,400% Gs (20°).

b. A developing apparatus according to the technical means a, characterized in that forming the irregularities is made in a spherical particle sand-blasting process.

c. A developing apparatus according to the technical means a, characterized in that forming the irregularities is made in an amorphous particle sand-blasting process before a spherical particle sand-blasting process.

d. A developing apparatus according to the technical means a, characterized in that forming the irregularities is made in an amorphous particle sand-blasting process before a lapping process with lap film.

e. A developing apparatus according to any of the technical means a, b, c, and d, characterized in that the pressing portion is magnetic.

The present invention can successfully form a stable, thin developer layer by making the surface of the stiff developer retainer (developing sleeve 3) irregular, providing the glossiness in the range mentioned above, and using a bar-like non-magnetic member or magnetic member to press the developer retainer as the developer amount limiting member.

The term "stiff" as used herein denotes a high stiffness, or a stiffness not lower than $10^4$ kg/cm$^2$. The developer amount limiting member available for the present invention is made of iron, its alloy, or similar magnetic metals having the stiffness of approximately 0.8 to $1.6\times10^6$ kg/cm$^2$, or of hard resins containing magnetic powder having the stiffness of approximately 1.0 to $10\times10^4$ kg/cm$^2$. An iron or iron alloys plated with chrome or similar metals are available for use in the present invention.

The term "magnetic" as used herein denotes a property of a material or substance to be attracted by a magnet.

The inventors performed the following experiments.

A developer layer was formed with a magnetic and nonmagnetic cylindrical bar 50 using an experimental apparatus as shown in FIG. 1. A magnet roller 4 having a plurality of magnetic poles was rotated around a developing sleeve 3 outside the magnet roller 4 in the direction of the arrow. The developing sleeve 3 was pressed against the cylindrical bar 50 using a spring balance. A pressing position of the cylindrical bar 50 faced a magnetic pole of the magnet roller 4. The graph shown in FIG. 2 was obtained with parameters of the graph being a pressing force applied to the cylindrical bar 50 and a diameter of the cylindrical bar 50. The term "pressing force" as used herein denotes the sum of a load F of the spring balance and the weight of the cylindrical bar 50, for the non-magnetic cylindrical bar 50, or in addition the sum of attraction of the magnetic force for the magnetic cylindrical bar 50. In FIG. 2, solid line curves indicate the magnetic cylindrical bar 50 and the dot-dash-line curves correspond to the non-magnetic cylindrical bar 50. As can be seen in FIG. 2, the developer conveyance amount is determined in terms of balance between two forces: a force that the developer entering a wedge-like area formed by the cylindrical bar 50 and the developing sleeve 3 exert on the cylindrical bar 50, and a force exerted by the cylindrical bar 50 as it is pressed toward the developing sleeve 3 by a spring or by the spring and a magnetic force. It also can be seen that the magnetic cylindrical bar 50 is operated to obtain a predetermined developer conveyance amount, even when the pressing force varies, in comparison with the non-magnetic one. Materials used for the non-magnetic cylindrical bar 50 in the experiment were non-magnetic SUSes, such as SUS 30, and polycarbonate. Materials for the magnetic cylindrical bar 50 were magnetic SUSes, such as SUSes 416 and 430, iron alloys, and hard resins containing magnetic powder.

For the experiment apparatus, the inventors used the stiff, magnetic cylindrical bar 50 the radius of curvature of which was 0.5 to 15 mm, preferably 1 to 10 mm, and set it to the pressing force of 1 to 15 gf/mm. A fairly stable desired conveyance amount could be obtained even when the pressing force varies in the initial operation of the apparatus. However, a too low pressing force reduced the limiting force for the developer so that steady equalization of the developer could not be maintained. It was not desirable as the conveyance was likely affected by vibration of the developer and other environmental effects. It also caused the coagulated developer to be passed through, resulting in not equalized developer layer.

On the contrary, a too high pressing force exerted a high load to the developer. The developer components were greatly adhered to portions around the limiting member and clogged into the limiting section. The limiting member tended to fail to limit the developer to form the thin layer.

In general, the surface of the developing sleeve 3 is precisely aground. However, the surface has sharp projections as shown in FIG. 19. The projections would cause such problems in pressure limiting as described previously.

Therefore, in order to overcome the problems, the inventors configured a novel developer for developing a latent image with a developing agent such as toner. The developer includes a developing sleeve for holding the developing agent on its surface, in which magnetic poles are provided in the developing sleeve; a equalizer bar for equalizing the amount of the developing agent on the surface of the developing sleeve; a pressing member to press the equalizer bar onto the developing sleeve. In the developer, a radius of curvature of the equalizer bar is between 0.5 mm and 15 mm, and the developing sleeve is processed to have a jagged surface which is defined by a glossiness between 2% Gs and 1400% Gs (20°).

BRIEF DESCRIPTION OF THE DRAWINGS

FIGS. 8*a* and 8*b* are an alternative of the example in FIG. 7 where pressure of leaf springs can be partially adjusted with an adjusting screw or screws.

FIG. 9 is yet another example for applying pressure to hold another developer layer limiting member of a semicircular cylindrical bar using a coil spring.

DETAILED DESCRIPTION OF THE INVENTION

Figure 18:
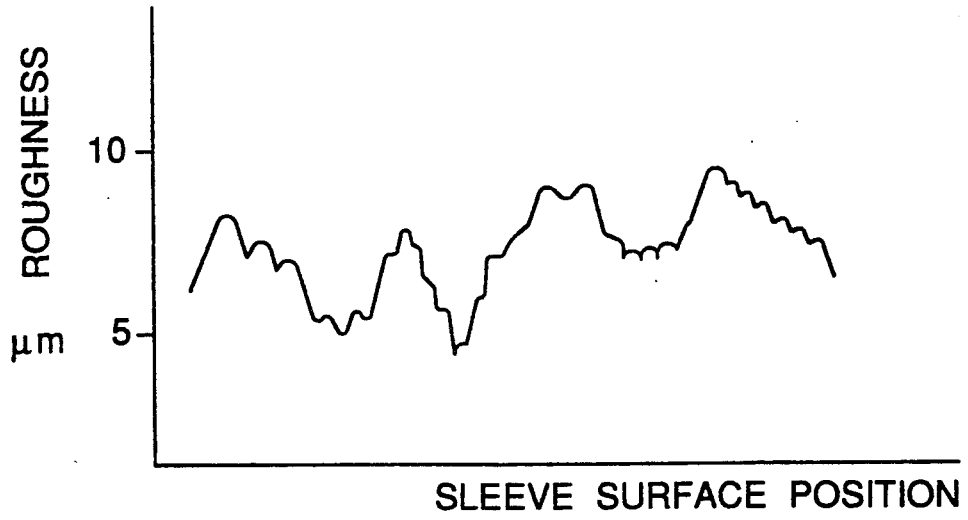
FIG. 18 is a graph showing a surface state of the developing sleeve of the present invention.
Figure 19:
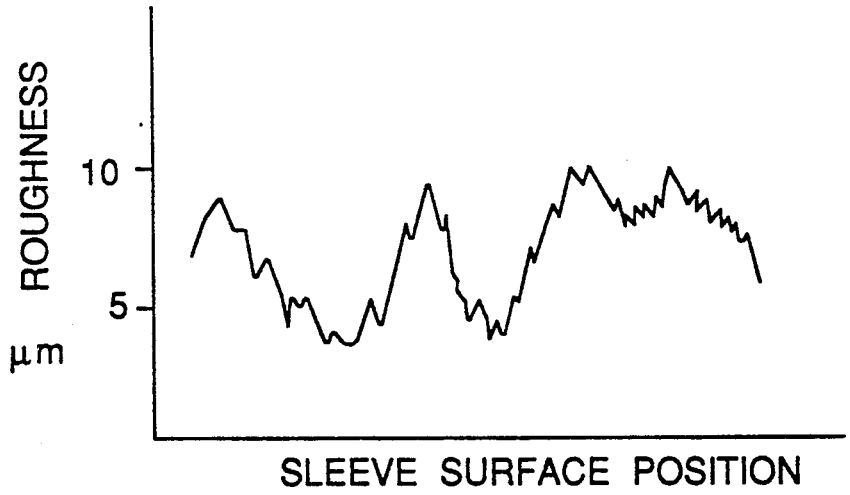
FIG. 19 (PRIOR ART)
FIG. 19 is a graph showing a surface state of a prior art developing sleeve.

In order to overcome the troubles, the inventors made the spherical particle sand-blasting process after grinding, or made a sand-blasting process before the spherical particle sand-blasting process and liquid honing process after grinding. This was to round the projections and remove burrs as shown in FIG. 18 to decrease unnecessary friction of the developing sleeve 3 with the toner on the pressing portion so that the pressing member could smoothly limit the developer layer thickness. As a result, limiting the developer could be made very stable without generation of the above-mentioned uneven lumps of the developer, clogging of the developer or dust, white streaks, and concentration unevenness. Alternatively, rounding the projections could be made in a way that they were sandblasted before being surface-lapped with lap film of, for example, Sumitomo 3M Co. (33-1, 2-chome, Tamagawadai, Setagaya-ku, Tokyo, Japan). The results were equivalent to the effects mentioned above. Note that the spherical particles available are preferably glass beads or similar particles.

The degree of gloss on the surface of the developing sleeve 3 obtained was in the range of 2 to 1,400% Gs (20°) as measured.

The pressure selected was preferably 1 to 15 gf/mm, more preferably 2 to 10 gf/mm, in view of various requirements mentioned above. The pressure mentioned above is optimum for the two-component developer having the magnetic spherical carrier given in Table 1. With this, the image obtained has no unevenness with desirable stable concentration.

Embodiment 1

Figure 1:
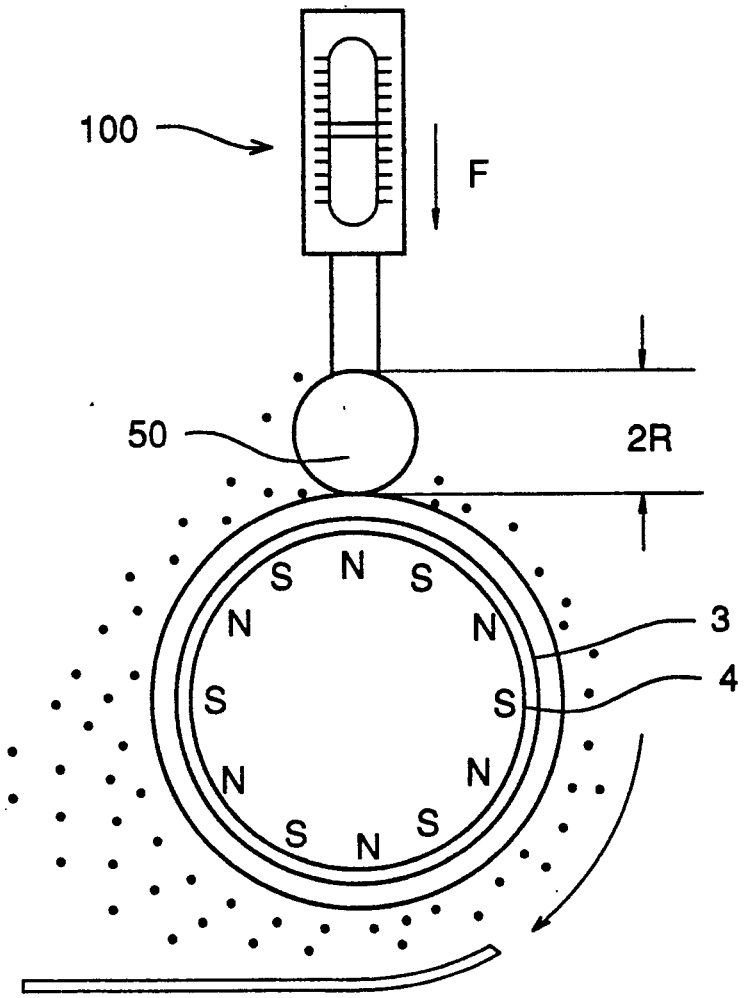
FIG. 1 is an elevational view of apparatus used to perform an experiment upon which the present invention is based.
Figure 2:
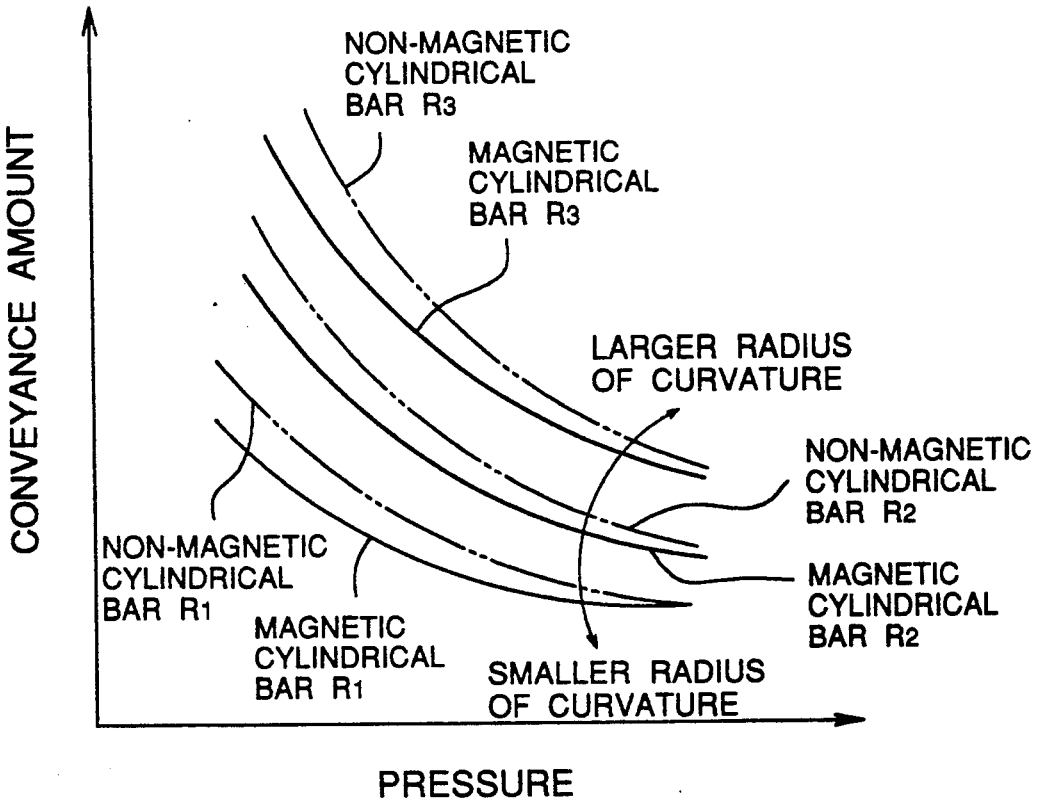
FIG. 2 is a graph of curves desired with the apparatus of FIG. 1 showing how a developer conveyance amount varies in response to pressure with parameters of magnetism and radius of curvature of a pressing portion.
Figure 3:
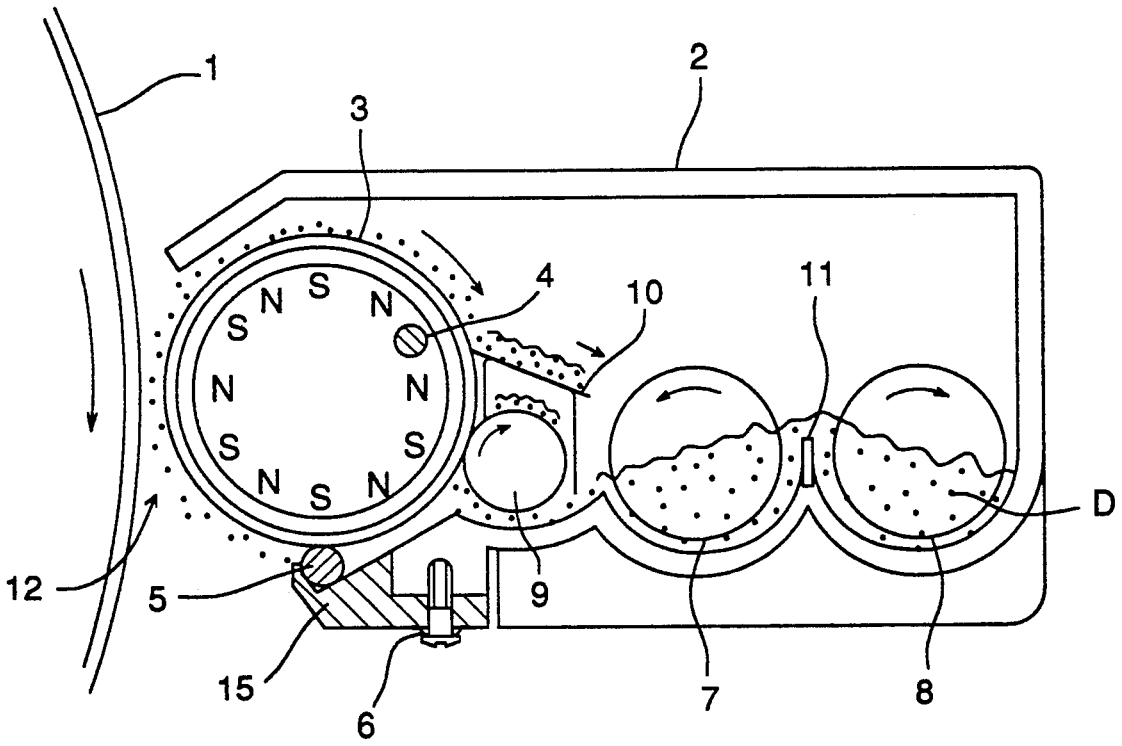
FIG. 3 is a cross-sectional view of major parts of the developing apparatus in a first embodiment of the present invention.

FIG. 3 is a cross-sectional view of major parts of the developing apparatus in a first embodiment of the present invention. The developing apparatus comprises an image retainer 1, a housing 2, a developing sleeve 3, a magnet roller 4, a stiff, magnetic limiting bar 5 for equalizing the amount of developer, a holder 15 for holding the limiting bar 5, a spring member 6 for allowing the developer to be conveyed against pressure applied to it by the limiting bar 5 and the developing sleeve 3 as the limiting bar 5 is pressed against the developing sleeve 3 by a certain force with no developer therebetween, a first stirring member 7, a second stirring member 8, a supply roller 9, a scraper 10, and a stirring partition plate 11.

The toner supplied into the developing apparatus is fully mixed with the carrier by the first stirring member 7 rotating in the rotating direction of the arrow and the second stirring member 8 rotating in an opposite direction to it. The mixture is fed to the developing sleeve 3 through the supply roller 9 as developer D.

The first stirring member 7 and the second stirring member 8 are screw-like members having a left helix angle which rotate opposite to each other in the directions of the arrows. The toner and the carrier conveyed toward the inside of the developing apparatus by the second stirring member 8 successively cross over the stirring partition plate 11 to the first stirring member 7. The first stirring member 7 conveys them in the direction perpendicular to the paper on which the figure is drawn, and upward. In this process, the toner and the carrier are made into homogeneous developer D charged by friction while being mixed. The developer D is adhered, like a layer, to a surface of the developing sleeve 3 by the sponge-like supply roller 9 rotating in the direction of the arrow indicated.

The surface of the developing sleeve 3 is irregularly rounded as shown in FIG. 18, as described previously.

Specification of the developer used in the first embodiment in FIG. 3 is shown in Table 1.

TABLE 1

| | ITEM | | | | | |
|---|---|---|---|---|---|---|
| DEVELOPER | Weight mean particle diameter μm | Specific resistance Ωcm | Charge, μc/g | Toner concentration wt % | Toner softening point, °C. | Toner glass transition point, °C. |
| Carrier | 45 | Over $10^{14}$ | Coating of MMA/st copolymer to 20 emu/g magnetized ferrite particles | | | |
| Toner Black | 15 | Over $10^{14}$ | −15 | 7 | 90–150 | 20–70 |

Figure 4:
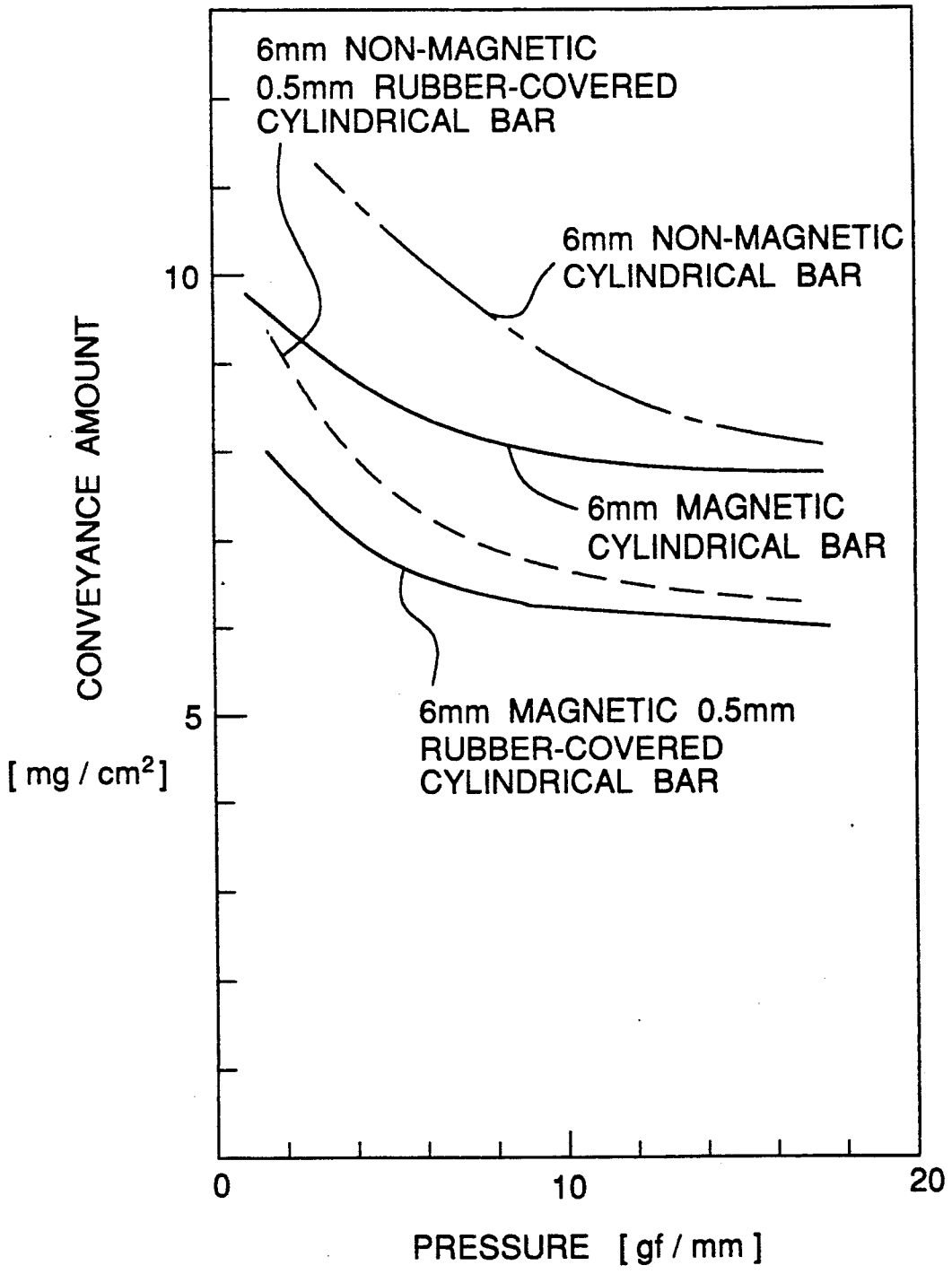
FIG. 4 is a graph showing comparison of conveyance amounts of the limiting bar and a stiff, non-magnetic cylindrical bar.

A bar of stiff, magnetic SUS of 6 mm diameter was used for the limiting bar 5, and a load of 2 to 6 gf/mm was applied to a position facing a magnetic pole of the magnet roller 4. As a result, a constant conveyance amount of 7 to 9 mg/cm$^2$ was obtained. The image obtained was stable in the concentration with no irregularity. A magnetic flux density at the pressing position on the surface of the developing sleeve 3 was 600 gausses. FIG. 4 is a graph showing comparison of conveyance amounts of the limiting bar 5 and a stiff, non-magnetic cylindrical bar of 6 mm diameter.

Figure 5:
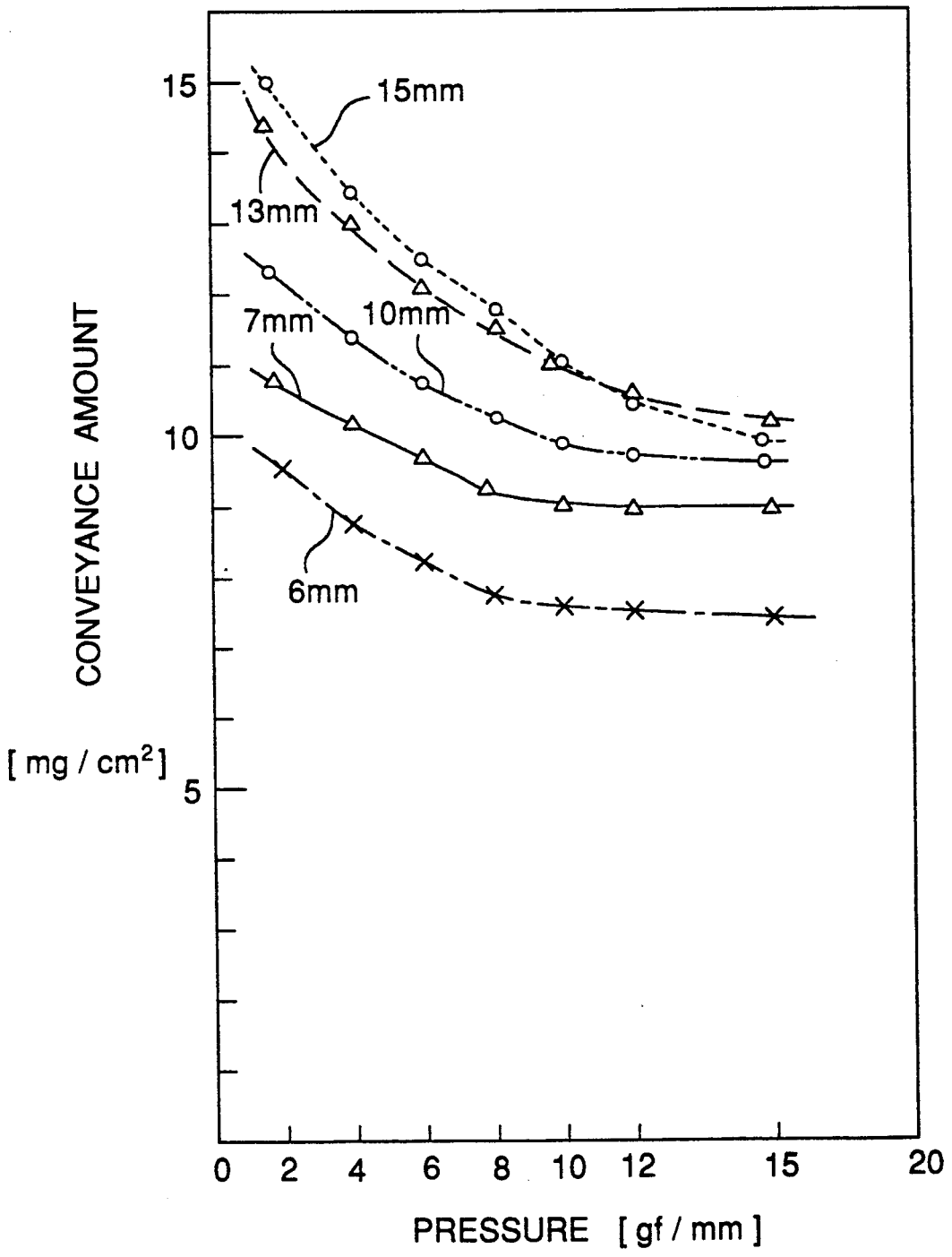
FIG. 5 is a graph showing variation of conveyance amounts of the stiff, magnetic limiting bar with respect to pressure with a parameter of diameter of the limiting bar.

FIG. 5 is a graph showing conveyance amounts of the stiff, magnetic limiting bar 5 with respect to pressure with a parameter of diameter of the limiting bar 5. With these graphs, we can select a proper conveyance amount. It was preferable that if the radius of curvature is 0.5 to 15 mm, the conveyance amount was stable as a force exerted on the limiting bar 5 by the developer D is well balanced with a force of the limiting bar 5 exerted on the developing sleeve 3. It was more preferable that if the radius of curvature is 1 to 10 mm, change of the conveyance amount was so little that the developer layer could be made homogeneous and thin irrespective of change of the pressure.

The inventors used a non-magnetic stainless steel for the stiff developing sleeve 3, and could have obtained the same effect with the use of metals, such as aluminum, hard resins, glass, ceramics, and similar stiff materials in place of the non-magnetic stainless steel. They also obtained the same effect with use of materials having surface roughness of 0.1 to 20 S, and preferably 0.3 to 10 S.

As described above, the developing sleeve 3 can have a homogeneous, stable, thin developer layer formed on the surface thereof in a range of 100 to 450 μm, and preferably 150 to 400 μm, and the layer is durable for a long period of time.

The first embodiment is constructed so that the fixed magnet roller 4 and the thin developer layer adhered to the surface of the developing sleeve 3 rotating counterclockwise outside it can develop a latent image on the image retainer 1 rotating in the direction of the arrow in a non-contact development process inside a gap in a developing area 12.

Figure 6:
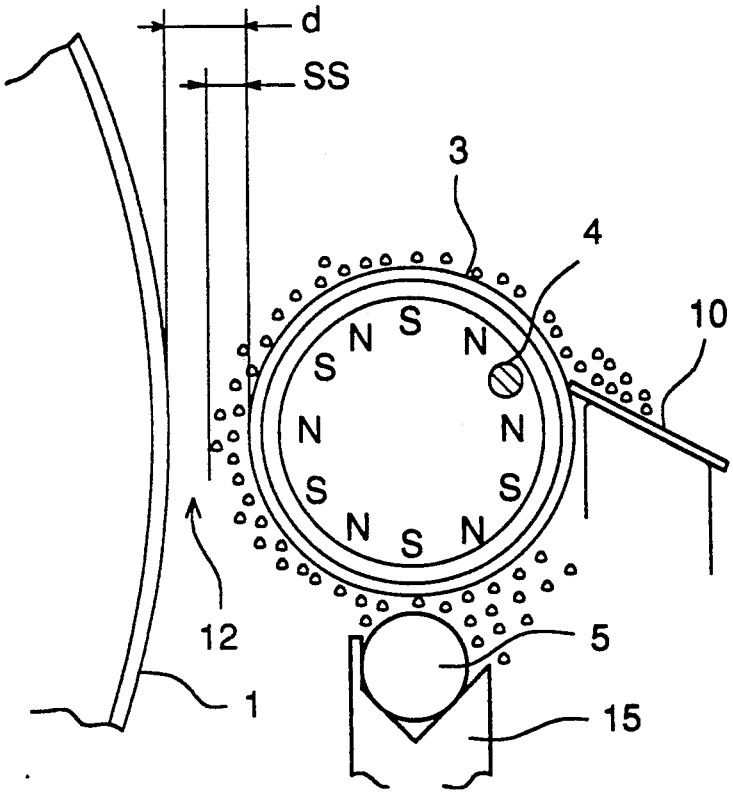
FIG. 6 is a cross-sectional view illustrating what the developer layer formed in the first embodiment shown in FIG. 3.

FIG. 6 is a cross-sectional view illustrating that the developer layer formed in the first embodiment shown in FIG. 3. Let d denote the nearest distance between the developing sleeve 3 and the image retainer 1 and SS be the height of the point of the developer. A necessary condition for the non-contact development process is d>SS.

In the non-contact development, a development bias containing an ac component is applied to the developing sleeve 3 from a power source (not shown). As a result, only the toner of the developer on the developing sleeve 3 is selectively moved to the latent image to adhere.

The developer having its toner component consumed becomes high in the concentration ratio of its carrier. It is conveyed by the developing sleeve 3 before being peeled off by the scraper 10 for collection. The collected developer is mixed with the developer of a higher concentration ratio of toner for re-use.

Specifications of the component parts forming the developing apparatus of the first embodiment in FIG. 3 are as follows:

The developing sleeve 3 is formed in a way that a thin cylindrical stainless steel of 20 mm outside diameter has its circumference honing-processed to roughness of 3 μm, and convex points are rounded by the surface treatment as shown in FIG. 18 to make less friction with the toner. The developing sleeve 3 is rotated 200 to 300 rpm, or 250 rpm clockwise in the first embodiment. The diameter of the developing sleeve 3 has to be made small so that the developing apparatus can be made compact. It is set to 15 to 30 mm by limitation of the magnet roller built in the developing sleeve 3. The inventors experimented as to the rotational speed of the developing sleeve 3 in various ways. If it is too low, supply of the developer is low, and the image concentration also is low when the latent image is developed. For the developing sleeve of 20 mm outside diameter, for example, the highest image concentration is linearly increased at the rotational speed of 0 to 200 mm. It is saturated at speeds higher than 200 rpm. If the environmental temperature is lower, the highest image concentration is lowered. The rotational speed has to be set with a slight allowance.

The magnet roller 4, as shown in FIG. 3, has 12 alternatingly arranged N and S poles magnets placed at equal intervals around its periphery. It has a repulsion magnetic field formed at a position at which the scraper 10 is made to contact. In order to make scraping the developer easy, the magnet roller 4 has one pole omitted to provide 11 poles in total. It is fixedly enclosed inside the developing sleeve 3. The magnetic force of each pole should be higher to make more of the carrier adhere to the image retainer 1. However, increasing the magnetic force is limited by fabrication difficulties depending on the shape of the magnet roller 4. It is kept at 500 to 700 gausses of the highest magnetic flux density, or 600 gausses in the first embodiment. The magnet roller 4 used is made of ferrite.

The limiting bar 5, as shown in FIG. 6, is faced with a magnetic pole of the magnet roller 4. It is pressed to the developing sleeve 3 and attracted by the magnetic force induced thereto to increase the pressure so that it can be attached to the developing sleeve 3 closely and evenly.

A stiff, magnetic limiting bar 5 was used as a developer layer limit member in the first embodiment. The image obtained was excellent and reliable without white streaks due to cohesion of the developer, sticking of the toner to the developer layer limit member in continuous copying, and image quality deterioration. This effect was virtually the same for the magnetic and non-magnetic cylindrical bars. The cylindrical bar may be magnetized so that it can be attracted to the developing sleeve 3 or vice versa.

As can be seen in the first embodiment, important factors of the stiff, magnetic developer layer limiting member determining the conveyance amount of the developer are its radius of curvature and pressure. FIGS. 7 to 13 are examples of the developer layer limiting member for giving various radii of curvature and pressures.

Figure 7:
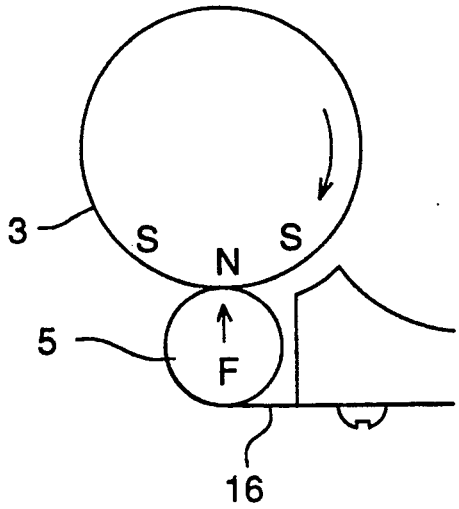
FIG. 7 is an example for applying pressure to hold the limiting bar using a leaf spring in the first embodiment.

FIG. 7 is an example for applying pressure to hold the limiting bar 5 with the use of a leaf spring 16. FIGS. 8(*a*) and 8(*b*) are alternatives of the example in FIG. 7 where pressures of leaf springs 16' can be partially adjusted with an adjusting screw or screws 61. A leaf spring 16' shown may be usefully formed to any of shapes that it is integrated with the limiting bar 5 in its axial direction, has a partial slit made thereon, and is fully split into two parts.

FIG. 9 is yet another example for applying pressure to hold another developer layer limiting member of a semicircular cylindrical bar 5*a* with use of a coil spring 17. In this example, a circular portion of the semicircular cylindrical bar 5*a* is pressed to the developing sleeve 3. In order to obtain the pressure required, a plurality of coil springs 17 should be arranged in the axial direction of the semicircular cylindrical bar 5*a*.

Figure 10:
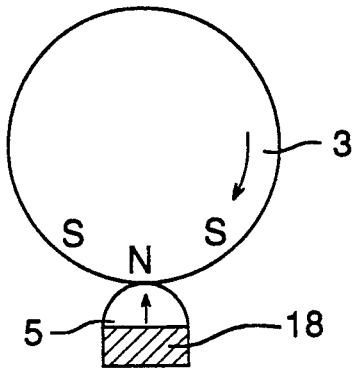
FIG. 10 is yet another example for applying pressure to hold a developer layer limiting member of the semicircular cylindrical bar using an elastic piece of rubber.

FIG. 10 is yet another example for applying pressure to hold a developer layer limiting member of the semicircular cylindrical bar 5*a* with use of an elastic piece 18 of rubber. The rubber can be replaced by foam of resin.

Figure 11:
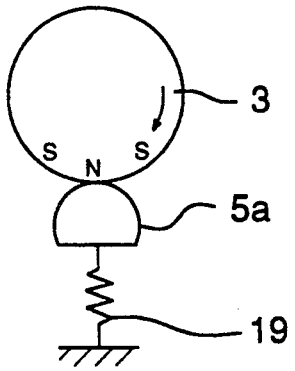
FIG. 11 is yet another example for applying pressure to hold a developer layer limiting member of the semicircular cylindrical bar using a compression spring.

FIG. 11 is yet another example for applying pressure to hold a developer layer limiting member of the semicircular cylindrical bar 5*a* with use of a compression spring 19

Figure 12:
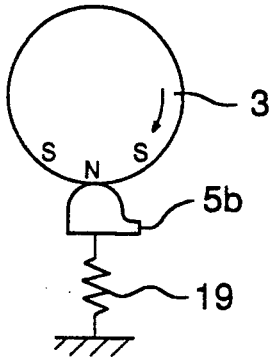
FIG. 12 is yet another example for applying pressure to hold another developer layer limiting member of a semicircular cylindrical bar having an edge in an upstream of the pressure using a compression spring.

FIG. 12 is yet another example for applying pressure with use of a compression spring 19 to hold another developer layer limiting member of a semicircular cylindrical bar 5*b* having an edge in an upstream side of the limiting member. The semicircular cylindrical bar 5*b* was a 6 mm radius curvature. The edge limits the developer layer to a predetermined thickness in advance. The semicircular cylindrical bars in FIGS. 11 and 12 are made of stiff, magnetic substance, and are placed at a position facing or near a pole of the developing sleeve 3.

Figure 13:
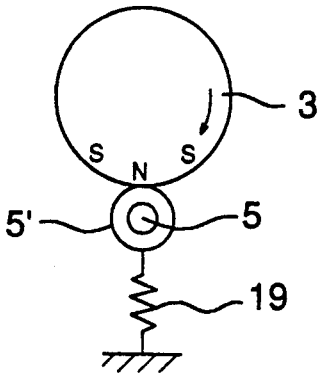
FIG. 13 is yet another example for applying pressure to hold developer layer limiting member having a layer using a coil spring.

FIG. 13 is yet another example for applying pressure to hold a developer layer limiting member having a layer 5' with use of a coil spring 17. The limiting bar 5 is coated with the thin rubber layer 5' of urethane, silicon, or the like on a surface thereof.

Thickness of the thin rubber layer 5' is preferably 0.01 to 1 mm.

Embodiment 2

Figure 14:
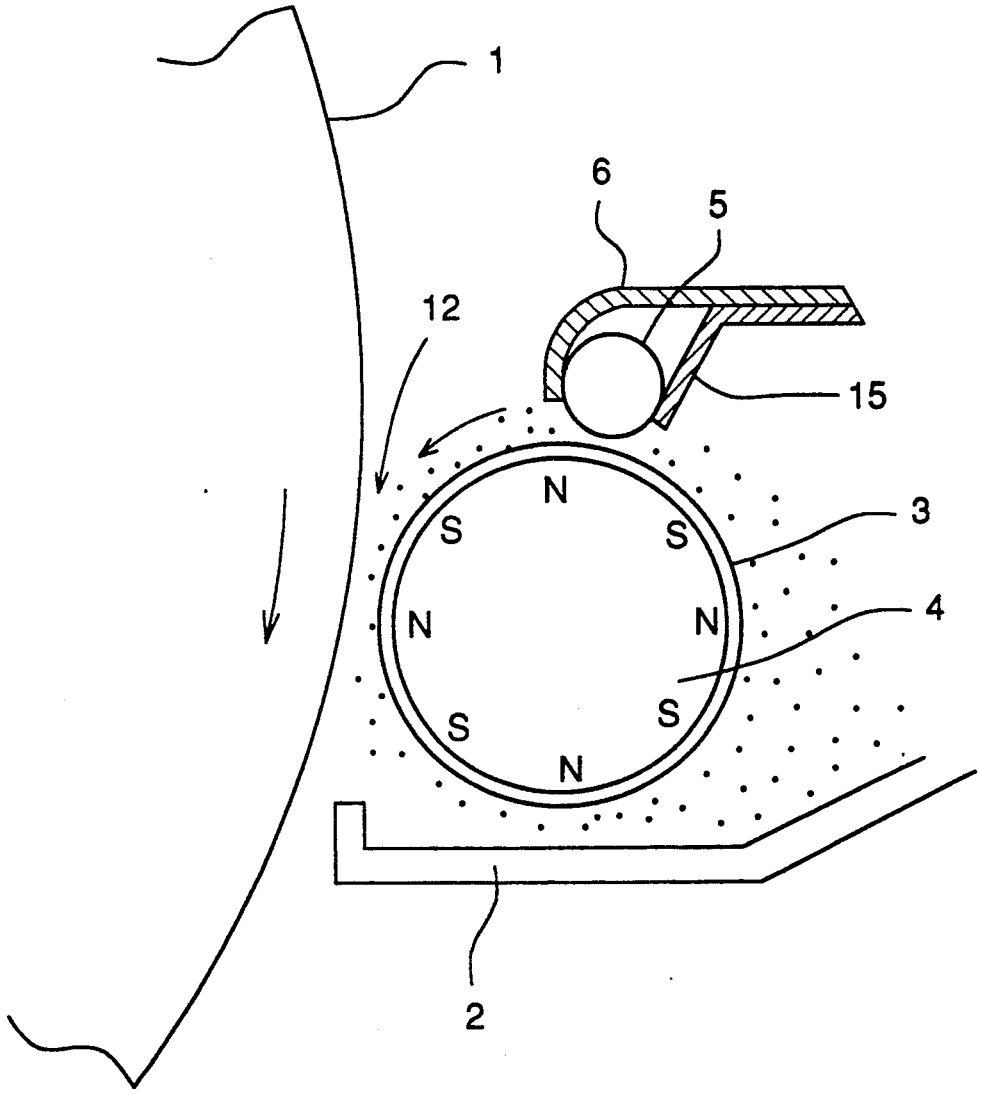
FIG. 14 is a cross-sectional view of major parts of the developing apparatus in a second embodiment of the present invention.

A second embodiment of the present invention uses the same developing apparatus as in the first embodiment shown in FIG. 3 except that the rotation direction of a developing sleeve 3 is made the same as that of the image retainer 1 in a facing area thereof. In the second embodiment, a limiting bar 5 of the developer layer limiting member is positioned as shown in FIG. 14. The developing sleeve 3 is made of non-magnetic stainless steel of 30 mm diameter with a surface roughness of 1 S. Convex points of the surface are rounded by the surface treatment as shown in FIG. 18. The magnet roller 4 used is of eight poles and 700 gausses of the magnetic flux density on the surface of the sleeve. The limiting bar 5 is made of a stiff, magnetic stainless steel SUS 416 and 7 mm diameter. It is positioned near a pole of the magnet roller 4 and pinched and held by a non-magnetic pressing spring member 6 and a holder 15. The other parts of the developing apparatus of the second embodiment in FIG. 14 are similar to those of the first embodiment in FIG. 3. The limiting bar 5 is made of a cylindrical, magnetic substance. It is magnetized by a magnetic field generated by the magnet roller 4 fixed in the developing sleeve 3 to be attracted magnetically. It provides a very good developer layer as it can press the developing sleeve 3 with its magnetically attracting force distributed uniformly lengthwise.

Embodiment 3

Figure 16:
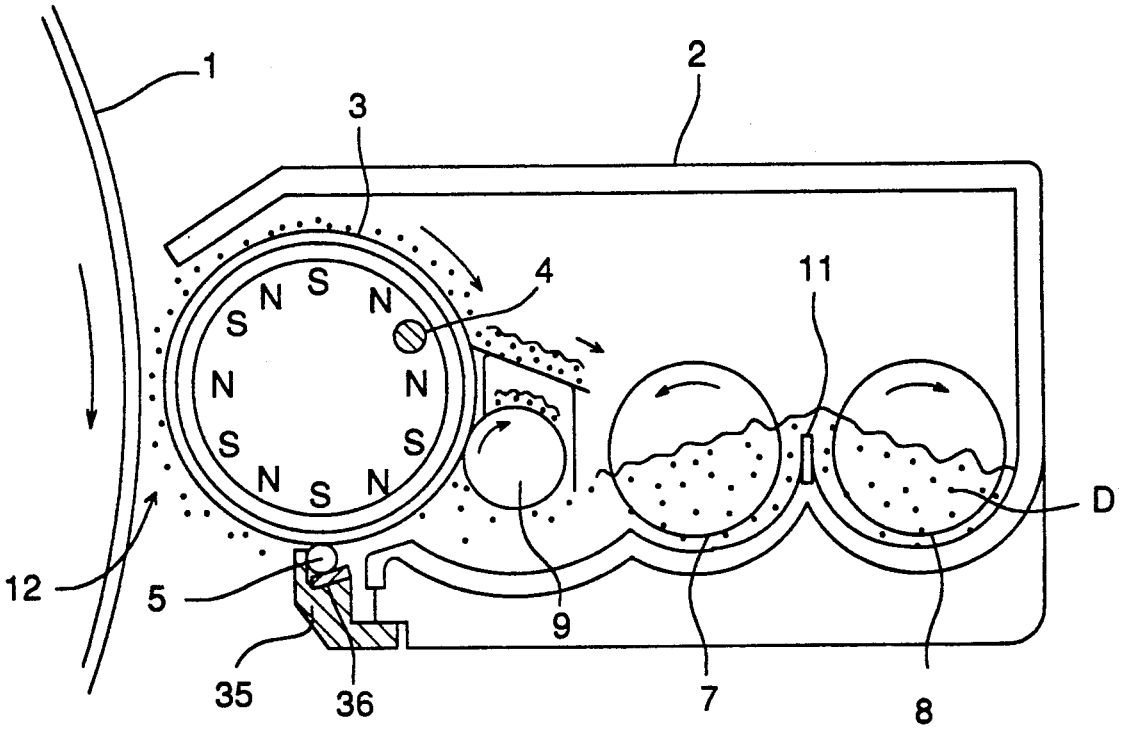
FIG. 16 is a cross-sectional view of major parts of the developing apparatus in a third embodiment of the present invention.

FIG. 16 is a cross-sectional view of major parts of the developing apparatus in a third embodiment of the present invention. The arrangements and parts in the figure identical with those in FIG. 3 are indicated by the same numbers as in FIG. 3. The third embodiment uses a nonlinear elastic member as the pressing member.

The developing sleeve 3 used is a cylinder of non-magnetic stainless steel and 20 mm outside diameter which is rotated, at 250 rpm in the direction of the arrow. Its surface is honing-treated to 3 S surface roughness. Convex points of the surface are rounded by the surface treatment as shown in FIG. 18.

The developing sleeve 3 has a magnet roller 4 of 11 poles fixed therein to provide a highest maximum flux density of 600 gausses on a surface thereof.

Figure 15:
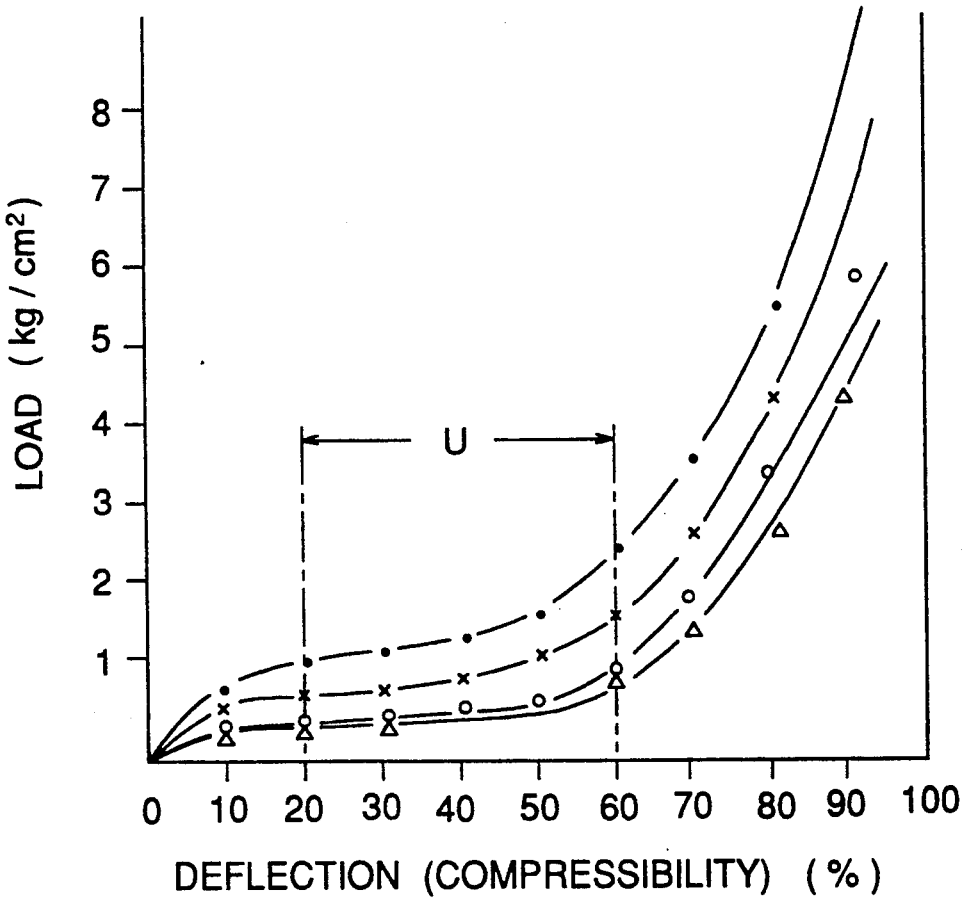
FIG. 15 is an example of characteristic curves of the nonlinear, elastic member.
Figure 17:
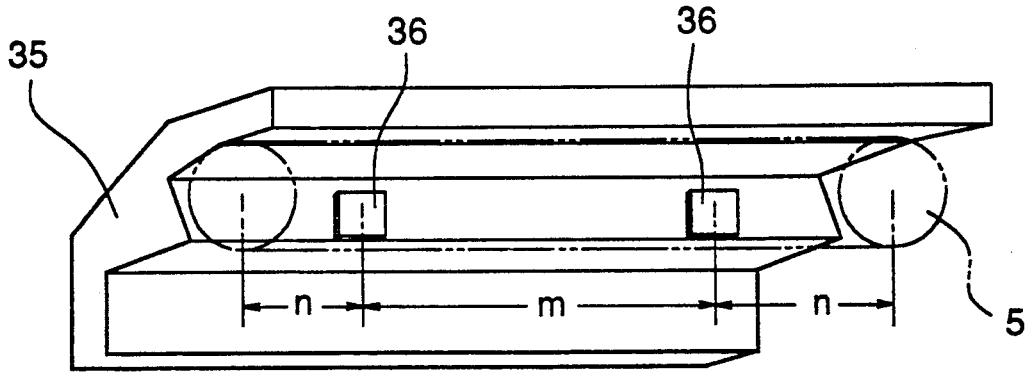
FIG. 17 is a perspective view illustrating installation of the nonlinear elastic members to the holder.

A stiff, magnetic limiting bar 5 is pressed to the developing sleeve 3 at a position facing a pole of the magnet roller 4. The limiting bar 5 is made of a magnetic stainless steel SUS 416. It is a precisely straight cylindrical bar of 6 mm diameter. Its surface is ground to 0.5 S, having no coat. It is kept from moving lengthwise by a holder 35 mounted on the housing 2 and is pressed in a pressing direction by two nonlinear elastic members 36. Each of the nonlinear elastic members 36 used in the third embodiment are the PORON [a product name of INOAC Corp. (2-70 Kamino-cho, Atsuta-ku, Nagoya-shi, Aichi-ken, Japan)] having characteristics which are shown in FIG. 15. It has little change of repulsion to deflection in a range of operation. It is shaped plate of 2 mm thick, 4 mm long, and 5 mm wide. It is adhered to the holder 35 to press the limiting bar 5. FIG. 17 is a perspective view illustrating installation of the nonlinear elastic members 36 to the holder 35. The members 36 press the limiting bar 5 at two points to which the full length of the limiting bar 5 is divided by a ratio of n:m:n=2:5:2. In such a condition, the pressure to 2 to 4 gf/mm. Deflection of the limiting bar 5 could be decreased. Conveyance of the two-component developer could be limited to 7 to 10 mg/cm$^2$ uniformly over the full axial length of the developing sleeve 3. The third embodiment has no particular adjusting points for limiting the conveyance of the developer, but the above-mentioned good development condition could be set and maintained.

For the nonlinear elastic members 36, the urethane foam PORON can be replaced by the SORBOTHANE available from Sanshin Kosan Co. (Ichiban-cho Central-building, 22-1 Ichiban-cho, Chiyoda-ku, Tokyo, Japan), α-gel, malt plane, or nonlinear springs.

As the pressing method of the nonlinear elastic members 36 to the limiting bar 5, the two-point support method mentioned above was effective to decrease the deflection of the limiting bar 5. Alternatively, the pressure can be made by a multi-point support or a continuous support. For use of these supports, full caution, however, should be taken in accuracy and parallelism of the holder 35.

The surface roughness of the developing sleeve 3 in the third embodiment is 3 S, and that of the limiting bar 5 is 0.5 S. It is desirable that the surface roughness should be lower than 0.5 just like a smoothness of a mirror. It is necessary that the surface roughness of the developing sleeve 3 should be high in view of the large conveyance amount of developer needed. Since the convex points of the surface should be rounded as, it is preferable that the surface of the developing sleeve 3 should be more rough than that of the limiting bar 5. In use for long time, the surface of the developing sleeve 3 tends to be gradually smoothened, resulting in reduction of the conveyance amount of the developer. In order to prevent this, it is desirable that surface hardness of the developing sleeve 3 be higher. It is seen by experiment that the limiting bar 5 also should preferably have approximately the same hardness.

So far, the three embodiments of the present invention have been described.

Most of the developer layer limiting members used in the embodiment of the present invention are the cylindrical bars, but the invention should not be limited to these. The embodiment can use any of stiff, magnetic bars of 0.5 to 15 mm radius of curvature at its pressing portion. Note that the cylindrical bars need not always be magnetic, but are preferably magnetic.

The environmental conditions and developer components available in the present invention include the following. The gap between the image retainer 1 and the developing sleeve 3, the value d in FIG. 6, in the developing apparatus of the present invention should be preferably 0.3 to 0.7 mm, and more preferably 0.4 to 0.6 mm. Narrow gap will increase the electric field effect and align the line of flux, causing no fuzz. If the gap is set to a mean value of 0.5 mm, the height of the developer points can be made 200 to 450 μm as any of the multi-pole magnet rollers is selected as described above. It is possible that the gap, d–S, between the developer points and the latent image should be kept to 0.05 to 0.3 mm, or the value of (0.1 to 0.6)×d.

It is preferable to use two-component developers as the developer for the present invention. It seems that the carrier of any of the two-component developers itself can clean the developer components which have adhered to the limiting member. The developer layer formed of the two-component developer can be stable for a longer period of time than that of a one-component developer. A two-component developer desirable in the developing apparatus of the present invention should be composed of a non-magnetic toner of 1 to 20 μm, preferably 2 to 12 μm or more preferably 3 to 9 μm particle diameter, and a carrier of 10 to 100 μm, preferably 30 to 60 μm particle diameter, having a resin covered on ferrite cores. The toner is described in detail below.

(1) Thermoplastic resins (adhering agent): 80 to 90 wt %

Examples: Polystyrene, styrene acrylic copolymer, polyester, polyvinyl butyral, epoxy resins, polyamide resins, polyethylene, ethylene acetate copolymer, or mixtures of these.

(2) Pigments (coloring agents): 0 to 15 wt %

Examples:

Black: carbon black.

Yellow: Derivatives of benzidine.

Magenta: Rhodamine B lake, carmine 6B, or the like.

Cyan: Copper phthalocyanine, derivatives of sulphonamide, or the like.

(3) Charge controlling agents: 0 to 5 wt %

Positive toners: Electron giving dyes of nigrosine, alcohoxylated amine, alkyl amide, chelate, pigments, grade 4 ammonium salt, and the like.

Negative toners: Electron accepting organic complexes, chlorinated paraffin, chlorinated polyester, polyester having too much acid radical, chlorinated copper phthalocyanine, and the like.

(4) Flow agents

Examples: Colloidal silica, hydrophobized silica, silicon varnish, metallic soap, non-ionic surface-active agents, and the like.

(5) Cleaning agents for preventing toner from filming on photosensing retainer (drum)

Examples: Pregnant aliphatate, oxide silicon acid having organic radical on surface, fluorine surface-active agents, and the like.

(6) Slips for improving surface gloss of image and decreasing material cost

Examples: Calcium carbonate, clay, talc, pigments, and magnetic powders for preventing surface bloom of image and splashing of toner. The magnetic powders include iron tetroxide, $\gamma$-ferric oxide, chromium dioxide, nickel ferrite, iron alloy, and similar powders of 0.1 to 1 $\mu$m. Their content should be 0.1 to 5 wt %. For clear color, it should be preferably less than 1 wt %.

As for resins that can be plastically deformed by force of around 20 kg/cm and available for pressure fixed toner on paper, these include wax, polyolefins, ethylene vinyl acetate copolymer, polyurethane, rubber, and similar adhesive resins.

The inventors tried development under condition that the surface potential on the image retainer 1 is $-600$ V, the exposing portion potential is 0 to $-100$ V, the dc bias to the developing sleeve 3 is $-500$ V, and the ac bias is 700 Vrms and 4 kHz of frequency. They confirmed that the toner image obtained had very high resolution, good gradation, and quality tone. The developers available, as shown in Table 1, may be either of one or two components. The toner softening point and the toner glass transition point can be selected from among considerably wide ranges of temperature.

As described so far, the developing apparatus of the present invention has the developer layer forming assembly constructed therein. The assembly includes the developer retainer (developing sleeve) and the developer layer limiting member. The developer retainer is stiff, has irregularities formed on the surface thereof, and has the convex points rounded. The developer layer limiting member is formed of the member which is stiff and magnetic and has the small radius of curvature. The developer layer limiting member is pressed to the developer retainer. With this construction, the developer layer obtained is not affected by any changes of the rotational speed of the developing retainer and the pressing position. Particularly, the conveyance amount of the developer can be stable despite any change of the pressing force. The thickness of the developer layer can be made stable. Thus, the developer layer obtained is more uniformed and stable with less pressing force than the prior ones.

Also, the developing apparatus of the present invention is featured in that it is difficult to cause clogging of foreign matters, excellent smashing of condensed toner, lump developer, and unlikely to have white streaks. Further, the developing apparatus provides excellent development as it has very little change in the limited developer layer due to variation of the pressure of the developer layer limiting member to the developer retainer. In particular, the developing apparatus can prevent the two-component developer from adhering to the limiting member. This leads to forming a stable, thin layer without irregularity and reproducing a quality image without density unevenness and density decrease.

Further, the developing apparatus of the present invention provides a great durability for the developer layer limiting member as the developer retainer (developing sleeve) is not deformed in a long period of operation and has little change in the magnetic attraction force. In mass production, also, it provides relatively wide installation tolerances, which is desirable for practical use.

Furthermore, the developing apparatus of the present invention has the advantage that it is difficult to cause an adverse effect due to the charge of static electrocity created by friction in the area where the developer layer limiting member is narrow, resulting in good image reproduction.

Still furthermore, the developing apparatus of the present invention has the advantage that the developer layer limiting member can be easily replaced, thus facilitating maintainability.

Still furthermore, the developing apparatus of the present invention has the advantage that if the nonlinear elastic member is used to press the cylindrical bar, it can absorb some accuracy errors of the casing and holder and dispersions of the parts in assembling. Thus, even if no adjusting points are provided, the developer can be always conveyed in a stable state.

Figure 20:
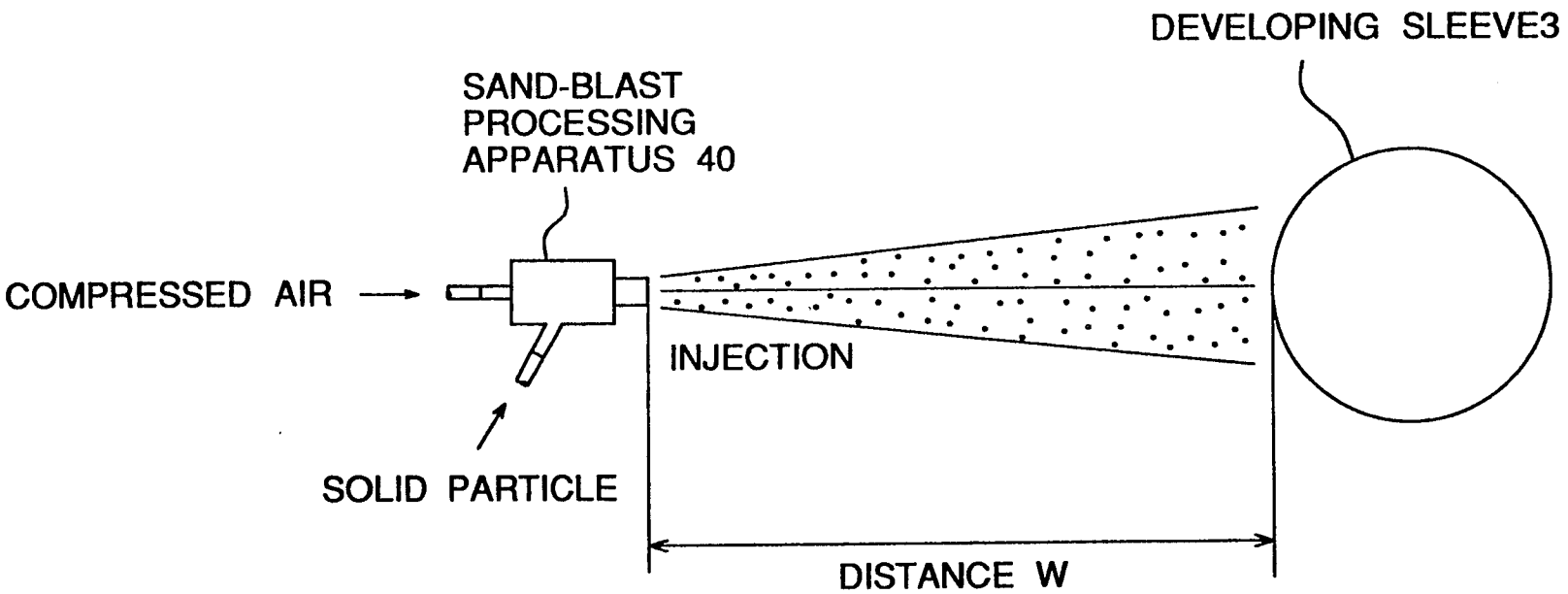
FIG. 20 is a view illustrating principles of the sand-blasting process used for the present invention.

The following describes a fourth embodiment in which the surface sand-blast processing is made in two steps: (1) the surface of the developer retainer to have the developer held thereon is treated amorphous particles by the sand-blasting process to have the irregularities formed thereon, and (2) the surface is further treated with large spherical particles by the sand-blasting process. FIG. 20 is a view illustrating principles of the sand-blasting process. In the figure, a sand-blasting apparatus 40 has compressed air and solid particles supplied thereinto. Upon being started, the sand-blasting apparatus 40 blasts the compressed air to project the solid particles toward the surface, of the developing sleeve 3, where the developer layer is formed.

After the step (1), a surface roughness Rz should be preferably 1 to 2 $\mu$m. After the step (2), that should be preferably 0.1 to 10 $\mu$m. The sand-blasting process facilitates the conveyance of the developer and inhibites clinging of the developer to the developing sleeve 3.

In order to obtain the preferable surface roughness Rz of 0.1 to 10 $\mu$m in the sand-blasting process with the large spherical particles, conditions for the sand-blasting process should be set as follows. An air pressure P should be 2 to 6 kg/cm$^2$, a distance W from an injection port to the developer retaining portion of the surface of the developing sleeve 3 should be 100 to 200 m, and a particle diameter of the large spherical particles should be 10 to 210 $\mu$m. This improves deviation of the developing sleeve 3 in fabrication and facilitates the conveyance of the developer and inhibites clinging of the developer since sharp projections on the developer retaining surface of the developing sleeve 3 can be crushed. The large spherical particles available include, for example, ceramic particles, glass particles, stainless steel spheres, iron spheres, and similar inorganic microparticles.

Figure 21:
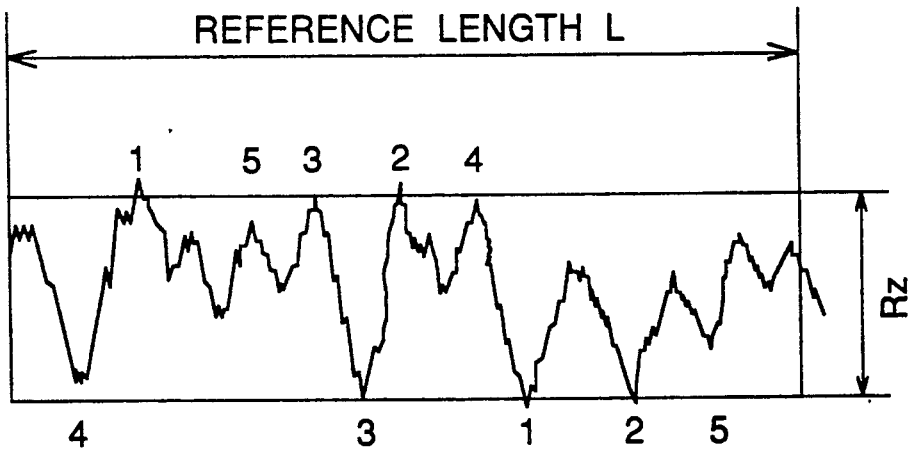
FIG. 21 is a graph illustrating surface roughness Rz of the developing sleeve used for the present invention.

The term "surface roughness Rz" used herein, as shown in FIG. 21, denotes a 10-point mean roughness that is interpreted as a distance in μm between two parallel lines drawn at a third highest peak of ten for a reference length L in parallel with a cross-sectional line and at a third lowest bottom in parallel as measured.

In short, the following features of the fourth embodiment are given by the sand-blasting process that the irregularities are formed on the developer retaining surface of the developer retainer of the developing apparatus, the amorphous particles are blasted to the surface, and the large spherical particles also are blasted to the surface in the predetermined conditions. The process improves the deviation of the developer retainer in fabrication and crushes the sharp projections on the developer retaining surface of the developer retainer. Thus, even though the stiff, magnetic member presses the developer to the layer, it can smoothly limit the developer as the developer retainer has no sharp projections on the surface to reduce friction with the toner. The developer can be repeatedly used for a long period of time as wear of the developer retainer due to the friction with the developer is reduced. Durability of the developer retainer can be increased as its surface is made harder.

Conditions for the sand-blasting process for improved deviation are described below.

The large spherical particles to be used are ceramic beads ($Al_2O_3$ of zirconia spheres) of 70 to 80 μm. The sand-blasting machine is, for example, the one of dry type, available from Fuji Seisakusho Co. The distance between the injection port and the surface of the developing sleeve 3 is 150 mm, the air pressure is 5 kg/cm$^2$, the vertical speed of the injection port is 40 mm/sec, the developing sleeve 3 is fixed and rotated at around 30 rpm, and the process time is longer than 70 sec.

The developing sleeve 3 having undergone the sand-blasting process is rotated clockwise at 200 to 300 rpm, or 250 rpm in the fourth embodiment of the present invention. Diameter of the developing sleeve 3 has to be made small so that the developing apparatus can be made compact. It is set to 15 to 30 mm by limitation of the magnet roller built in the developing sleeve 3. The inventors experimented as to the rotational speed of the developing sleeve 3 in various ways. If it is too low, supply of the developer is made low, and the image concentration also is low when the latent image is developed. For the developing sleeve of 20 mm outside diameter, for example, the highest image concentration is linearly inceased at the rotational speed of 0 to 200 mm. It is saturated at a higher speed than 200 rpm. If the environmental temperature is lower, the highest image concentration is lowered. The rotational speed has to be set with a slight allowance.

The physical surface treatment of the developing sleeve 3 can be made to a similar degree of effect by a surface thin layer process in place of the sand-blasting process. The inventors made measurements and evaluations on the following three cases of the developing sleeve 3 of 20 mm diameter subjected to the surface sand-blasting or thin layer process. The measurements used a full color copying machine, the Konica DC9028 for single color, continuous copying. Measurement items included a primary adhesion amount M/A of a solid image in mg/cm$^2$ on the photosensing retainer (drum) for each unit of copied sheets, developing efficiency in %[1], the developer layer thickness in mm, and the developer sleeve surface roughness Rz in μm[2]. As a result, they found that the process by Ni-PTFE (nickel-polytetrafluoroethylene) was superior to the others. The Ni-PTFE is known as "Nifron," a trademark. The Nifron is an electroless nickel-phosphorus/PTFE compound plating solution having a film composition of nickel of 84+,−1 wt %, phosphorus of 9+,−1 wt %, and PTFE particles of 7+,−1 wt % (22+,−1 vol %). The plating surface treatment with use of the plating solution lowers the friction coefficient as the PTFE particles as solid lubricant is uniformly dispersed and in an eutectoid state in the plated film. The thermal treatment can make the film harder.

Experiment conditions

Case 1: A developing sleeve having the machined sleeve surface treated with alumina particles by the sand-blasting process.

Case 2: A developing sleeve having film of thermosetting phenol resin and carbon of conductive microparticle formed to 10 μm thick on the surface of the developing sleeve given in case 1 above in a spray method.

Case 3: A developing sleeve having film of Ni-PTFE layer formed to 10 μm thick on the surface of the developing sleeve given in case 1 above in an electroplating method. The developer used is composed of a toner $d_{50}$ of 8.5 μm, a carrier of $D_{50}$ of 45 μm, and a toner concentration $T_c$ of 7%.

Note 1: The developing efficiency can be calculated with use of Eq. 1: below in terms of the measured primary adhesion amount M/A in mg/cm$^2$ and developer conveyance amount $D_{ws}$ in mg/cm$^2$.

$$\text{Developing efficiency} = \frac{M/A}{Vr/Vp \times Dws \times Tc/100} \times 100\ (\%)$$

Note 2: The term "surface roughness Rz" used herein, as shown in FIG. 21, denotes a 10-point mean roughness specified in the JIS that is interpreted as a distance in μm between two parallel lines drawn at a third highest peak of ten for a reference length L in parallel with a cross-sectioned line and at a third lowest bottom in parallel as measured.

| | Q'TY OF COPIES | | | | |
|---|---|---|---|---|---|
| SLEEVE | Start | 2,500 | 5,000 | 7,500 | 10,000 |
| Case 1 | Little scratching | Scratch | Scratch | Too much scratching | Too much scratching |
| Case 2 | Good | Good | Smash | Too much smash | Too much smash |
| Case 3 | Good | Good | Good | Good | Good |

Figure 22:
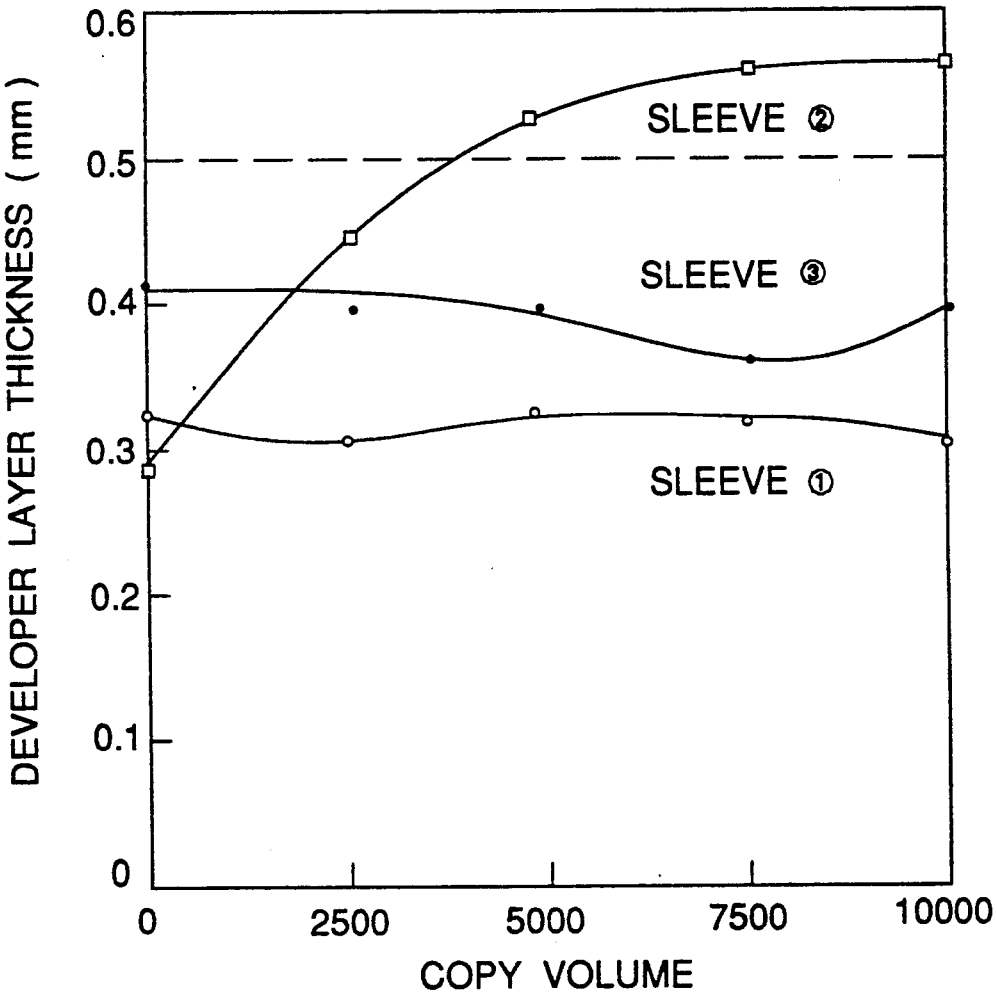
FIG. 22 shows curves for changes of the developer layer thicknesses.
Figure 23:
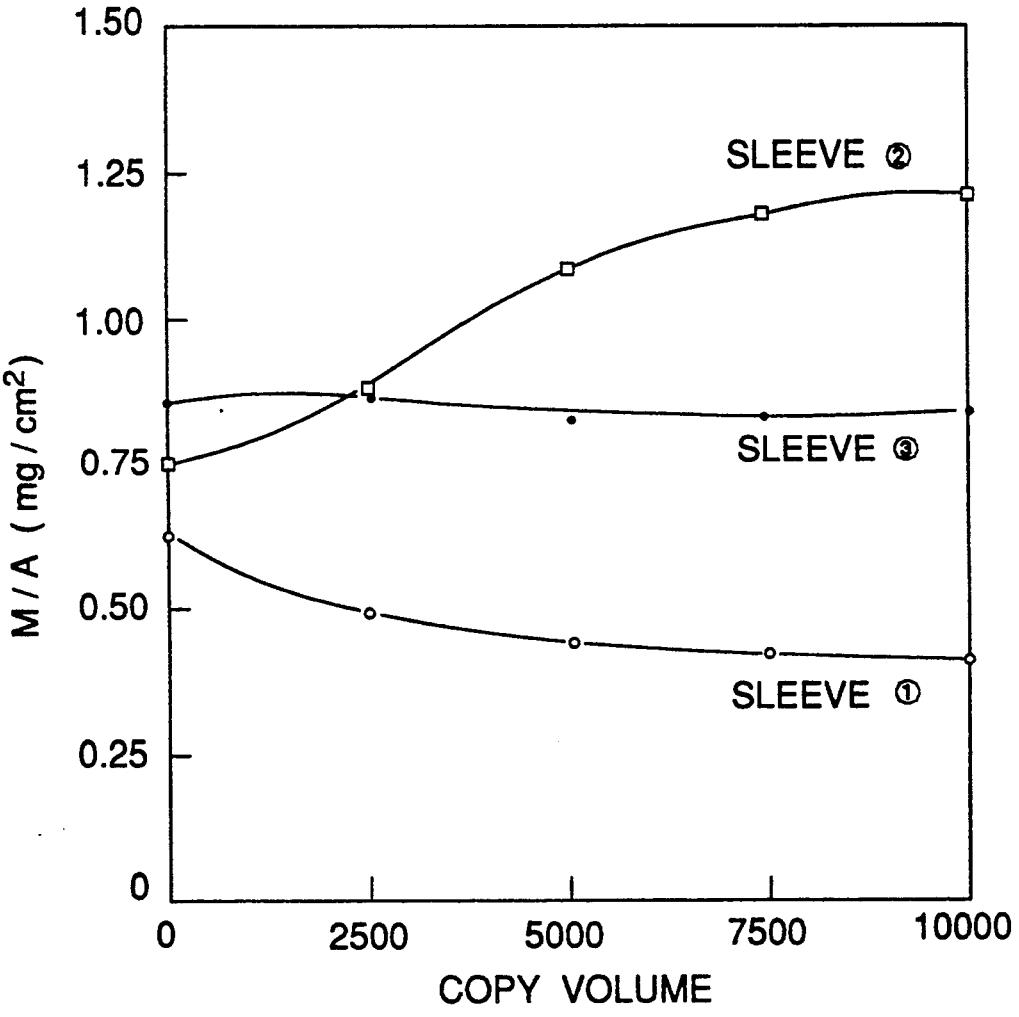
FIG. 23 shows curves for changes of the primary adhesion amounts of M/A.
Figure 24:
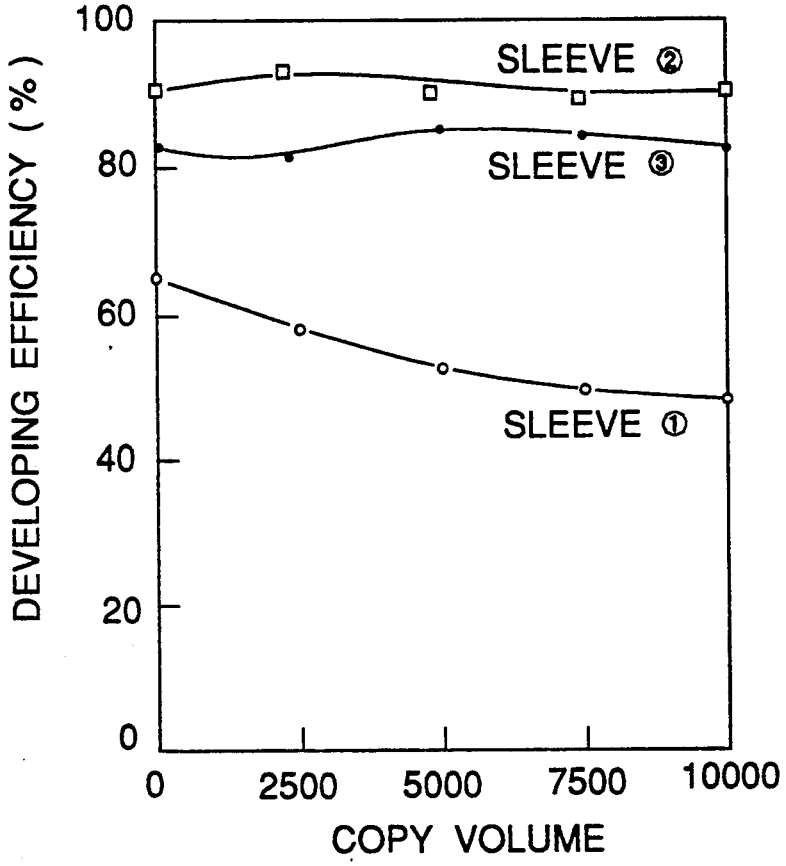
FIG. 24 shows curves for changes of the developing efficiencies.
Figure 25:
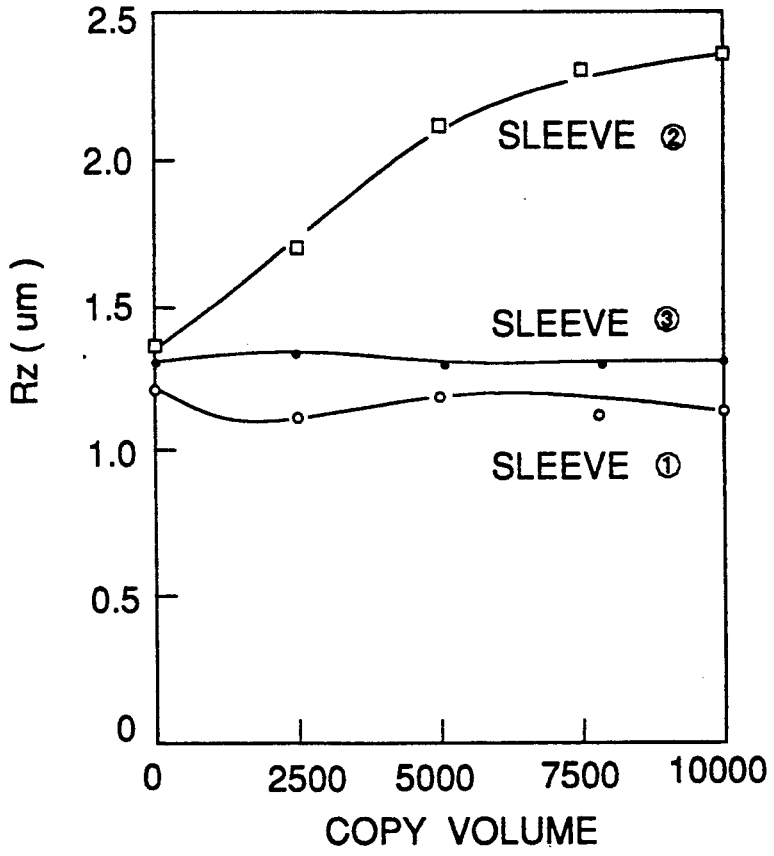
FIG. 25 curves for changes of the developing sleeve surface roughnesses Rz.

Measurement results of the developing sleeves in cases 1 to 3 are shown in FIGS. 22 to 25 and Table 2. FIG. 22 shows curves for changes of the developer layer thicknesses. FIG. 23 shows curves for changes of the primary adhesion amounts M/A. FIG. 24 shows curves for changes of the developing efficiencies. FIG. 25 shows curves for changes of the developing sleeve surface roughnesses $R_z$. Table 2 is a chart for character reproducibility of the developing sleeves.

It can be seen in FIG. 22 that the blast developing sleeve in case 1 can keep the thin developer layer for a long period of time. However, it also can be seen in FIGS. 23 and 24 that it is not good in the initial development capability. The development capability decreases further with an increase in the copy quantity. As a result, the reproductions are poor quality.

It can be seen in FIGS. 22 and 25 that the developing sleeve coated with the resin containing the conductive microparticle in case 2 increases in the surface roughness $R_z$. With this, the developer layer becomes thicker, resulting in contact of the developer with the photosensing retainer (drum) in 5,000 copies. It is found in FIG. 24 that no change of the developing efficiency is made. However, it is found in FIG. 23 that the primary adhesion amount increases, resulting in striking of smashing of thin lines.

On the contrary, the Ni-PTFE plated developing sleeve in case 3 can keep a good image for a long period of time.

Further, for the Ni-PTFE plated developing sleeve in case 3, the inventors changed the Ni-PTFE layer thickness and the content of the PTFE microparticles to obtain optimum values under the same experimental conditions of the copying machine used, the developing conditions, and the developer.

(1) Changing the Ni-PTFE layer thickness

The Ni-PTFE layer thickness is effective in a range of 1 to 50 μm. If it is thinner than 1 μm, the desired development effect cannot be obtained, resulting in a scratched image. If thicker than 50 μm, designing the surface roughness of the developing sleeve is too hard to keep an optimum developer conveyance for a long period of time.

(2) Changing the content of the PTFE microparticles

The content of the PTFE microparticles is effective in a range of 10 to 45 wt %. If it is less than 10 wt %, development becomes worse as the toner becomes hard to separate from the surface of the developing sleeve. If larger than 45 wt %, coat peeling occurs in a long period of operation as the adhesion decreases; and, development becomes worse with charge-up of the toner due to an increase of the surface resistance of the developing sleeve to insulation.

The developing apparatus of the present invention has the advantage that it provides a quality image even with use of thin, non-contact development and low softening toner of small particle diameter since it can obtain higher developing efficiency and keep a uniform image for a long period of time.

The following describes components of the two-component developer involved in the present invention in further detail. The lubricants available are preferably metal salts of aliphatic acids, such as stearic acid and palmitic acid, including, for example, salts of zinc, aluminum, lead, magnesium, and lithium, particularly aluminum stearate and magnesium stearate. The addition amount of any of the lubricants is 0.01 to 2 weight parts in the toner of 100 weight parts.

The lubricant acts as follows. It adheres to the toner particles having fluidizing agent particles to prevent the contact area from decreasing or to keep the toner particles from entering concaves on the sleeve surface to which the rolling action between the contacting matters cannot reach. The action of the lubricant can spread the developer on the sleeve surface to a great extent as it is multiplying the previously described rounding effect of the projections of the cross-sectioned curve on the sleeve surface. It also can increase durabilities of the developer, the sleeve, and the limiting member.

No particular limitations are given to any of the carriers to compose the two-component developer in the present invention. The ones available are resin covered carriers that surfaces of magnetic particles are coated with resin.

The magnetic particles available to compose the carrier are particles of substances which can be strongly magnetized by the magnetic field in its direction. The substances include iron, ferrite, magnetite, nickel, cobalt, and similar ferromagnetic metals or alloys or compounds containing any of these elements.

The preferred resins for the resin coated carriers include, for example, styrene-acrylic copolymers, such as polystyrene-methylmethacrylate, silicon compounds, and fluoric resins.

A mean particle diameter of the carrier should be 20 to 100 μm, preferably 20 to 70 μm, to further decrease the carrier adhesion phenomenon for a clearer image and to prevent image roughness. The mean particle diameter (weight) of the carrier as used herein denotes a value measured with use of the Microtrack of Nikkiso Co.

A particle diameter of the toner particles involved in the present invention should be 1 to 20 μm, preferably 3 to 9 μm, the toner softening point should be preferably 90° to 150° C., and the glass transition point should be preferably 20° to 770° C.

Although no particular limitations are given to any of the binder resins for use in the toner, polyester resin being copolymer is preferable for the toner to have a high negative charge.

Other binder resins include epoxy resin, vinyl polymer, and styrene copolymer.

The toner involved in the present invention has a colorant contained in the binder of the polymer resin mentioned above. It further can have a characteristics improving agent contained in the resin as desired.

The colorants include, for example, carbon black, chrome yellow (C. I. No. 14090), Dupon oil red (C. I. No. 26105), kinoline yellow (C. I. No. 47005), malachite green oxarate (C. I. No. 42000), and mixtures of these substances. The colorant amount should be ordinarily 0.1 to 20 weight parts in the toner of 100 weight parts, preferably 0.5 to 10 weight parts.

The characteristics improving agents available include fixing improving agents, charge controlling agents, and others.

The fixing improving agents available include, for example, polyolefins, ester methalate, ester aliphatates, waxes of ester aliphatates, partially saponificated ester aliphatates, high grade aliphatic acids, high grade alcohols, fluid or solid paraffin waxes, polyamide waxes, polyalcohol esters, silicon varnishes, and aliphatic phlorocarbons. It is particularly preferable to use the waxes of which the softening point is 60° to 150° C. when measured in the ring and ball method stipulated in the JIS 1K 2531.

The charge controlling agents available are known ones, for example, dyes of the nicrosine group, metal containing azo dyes, and metal complex salts.

Further, the toner in the present invention can preferably have inorganic microparticles, such as a fluidity improving agent mixed therein.

The inorganic microparticles available in the present invention should have the primary particle diameter of 5 μm to 2 μm, preferably 5 to 500 μm. The specific surface area by the BET method should be preferably 20 to 500 $m^2/g$. Amount of the inorganic microparticles mixed in the toner of 100 weight parts should be 0.01 to 5 weight parts, permeably 0.01 to 2.0 weight parts. The inorganic microparticles available include, for example, silica micropowder, alumina, titania, balium titanate, magnesium titanate, calcium titanate, strontium, titanate, tin oxide, selenium oxide, antimon trioxide, zirconium oxide, and silicon carbide. Of all, the silica micropowder is particularly preferable.

Amount of the inorganic microparticle should be preferably 0.01 to 5 wt % of the whole toner, more preferably 0.05 to 2 wt %.

The toner in the present invention should be mixed with the carrier for use in the two-component developer.

In order to fabricate the two-component developer for use in the present invention, the binder for the toner should have the colorant contained therein first, and have the additives contained therein as needed. They should be mixed together using a ball mill, kneaded, ground, and graded to obtain toner powder. In turn, the toner powder should have the lubricant and inorganic micropowder added thereto and mixed therewith using a turbira mixer before they should be mixed with the carrier having been prepared. This completes the developer.

What is claimed is:

1. A method of finishing a surface of a means for holding a developing agent thereon in a developing apparatus for developing a latent image with a developing agent, comprising the steps of:

providing a smooth surface of the holding means;

sand-blasting said surface of the holding means with amorphous particles; and sand-blasting the surface of the holding means with spherical particles, after said sand-blasting step with amorphous particles.

2. The method of claim 1, further comprising the step of;

lapping said holding means with a lap film, after said sand-blasting step with amorphous particles.

3. The method of claim 1, wherein a surface roughness of said surface of the holding means, after said sand-blasting step with amorphous particles, is between 0.1 μm and 2 μm; and a surface roughness of said surface of the holding means, after said sand-blasting step with spherical particles, is between 0.1 μm and 10 μm.

4. The method of claim 1, wherein said sand-blasting step with spherical particles uses spherical particles having a particle diameter between 10 μm and 210 μm.

5. The method of claim 1, wherein the spherical particles, used in said sand-blasting step with spherical particles, are at least one kind of ceramic particles, glass particles, stainless steel spheres, and iron spheres.

* * * * *